US005542584A

United States Patent [19]

Konar

[11] Patent Number: 5,542,584

[45] Date of Patent: Aug. 6, 1996

[54] BOXED LIQUID VALVE OPERATOR

[76] Inventor: Ronald C. Konar, 7280 S. Highland Dr., Littleton, Colo. 80120

[21] Appl. No.: 540,475

[22] Filed: Oct. 10, 1995

Related U.S. Application Data

[63] Continuation-in-part of Ser. No. 345,319, Nov. 28, 1994, abandoned.

[51] Int. Cl.[6] ..... B65D 47/20

[52] U.S. Cl. ..... 222/505; 222/517

[58] Field of Search ..... 222/105, 213, 222/214, 185.1, 505, 517, 511, 570; 251/299, 303

[56] References Cited

U.S. PATENT DOCUMENTS

| | | | |
|---|---|---|---|
| 3,400,866 | 9/1968 | Fattori | 222/511 |
| 4,621,750 | 11/1986 | Roethel | 222/505 |
| 4,887,742 | 12/1989 | Roethel et al. | 222/153 |
| 4,905,875 | 3/1990 | Straiton | 222/505 |
| 4,921,136 | 5/1990 | Roggenburg | 222/95 |
| 4,927,061 | 5/1990 | Leigh et al. | 222/212 |
| 4,938,386 | 7/1990 | Roethel et al. | 222/505 |
| 5,074,441 | 12/1991 | Taguchi et al. | 222/517 |
| 5,230,447 | 7/1993 | Kirk | 222/505 |
| 5,402,919 | 4/1995 | Atkinson | 222/505 |

FOREIGN PATENT DOCUMENTS

| | | | |
|---|---|---|---|
| 2415586 | 9/1979 | France | 222/570 |

*Primary Examiner*—Andres Kashnikow
*Assistant Examiner*—Philippe Derakshani
*Attorney, Agent, or Firm*—Thomas J. Loran

[57] ABSTRACT

An attachment to a nozzle and spigot valve on bag-in-the-box liquid container providing mechanical advantage and improved accessibility to open the valve. The attachment includes a mounting means and two surfaces, an upper surface and a lower surface, joined by a pivot in front of the nozzle and spigot that when the surfaces are compressed between finger and thumb, easily opens the spigot valve. By extending the upper and lower surfaces beyond the pivot, additional mechanical advantage to open the valve is also achieved.

7 Claims, 4 Drawing Sheets

BOXED LIQUID VALVE OPERATOR

This is a continuation-in-part of Ser. No. 08/345,319 filed Nov. 28, 1994 abandoned.

BACKGROUND—FIELD OF INVENTION

This invention is to enhance the operation of generic valve assemblies typically used on bag-in-the-box fluid containers by providing a positive mechanical operating advantage.

BACKGROUND—DESCRIPTION OF THE PRIOR ART

An extensive search of associated U.S. Patent classes and sub-classes revealed a small quantity of bag-in-the-box fluid control devices and no devices to enhance the operation of an existing generic valve assembly, such as those typically used on wine-in-the-box products.

It appears that there is no published art for a device which attaches directly to, or is manufactured as part of, the generic valve assembly and provides the mechanical advantage of large grip areas for full finger purchase thus enhancing operation.

This search led to U.S. Pat. No. 4,621,750 issued to Roethel and U.S. Pat. No. 4,927,061 issued to Leigh and Roethel, both revel complete valve assemblies with a single operating lever. Neither can be used as an attachment to a generic valve assembly.

U.S. Pat. No. 4,887,742 issued to Roethel and Leigh which discloses a complete valve assembly for bag-in-the-box beverages. This device would not function as an attachment to, or as a part of a generic valve assembly.

U.S. Pat. No. 4,921,136 issued to Roggenburg is for a liquid dispenser combining a flexible bag and a dispensing nozzle not a device for enhancing the operation of a valve assembly.

SUMMARY OF THE INVENTION

This invention provides enhanced thumb and forefinger purchase for improved squeezing action providing reduced physical exertion when dispensing fluids from bag-in-the-box containers.

As the container is lowered in temperature, to provide a more desired consumption temperature, the small valve operator of the generic bag-in-the-box container becomes less pliable and therefore more difficult to operate. The invention provides the mechanical advantage to overcome this difficulty.

Should an individual have a weakened gripping ability do to age or a debilitating affliction such as arthritis, the invention will turn a difficult or impossible task into an easy one.

This invention when fabricated with a sports team or corporate logo and/or colors will provide unique, desirable configurations.

DRAWING FIGURES

DESCRIPTION OF THE PREFERRED EMBODIMENTS

Figure 1:
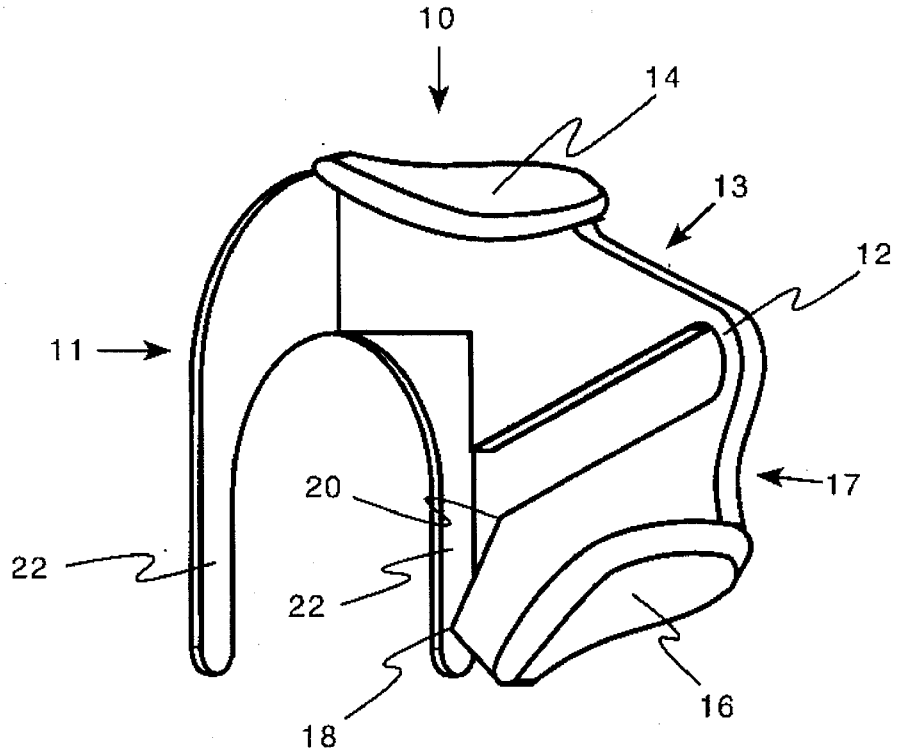
FIG. 1 shows the preferred embodiment in the perspective view.

With reference to FIGS. 1 through 4 the single piece valve operator 10 of the present invention can be seen as a one piece molded device manufactured from a resilient plastic such as a polyvinylchloride or the like. The arch 24 will be a radius corresponding to the specific generic valve assembly 50 for which this particular single piece valve operator 10 is designed to be used in conjunction with. The mount finger 22 extends from each end of the arch 24, downward and parallel one with the other, providing effective installation guidance and securing the valve operator on the generic valve assembly 50 when pressed downward to the fully seated position.

Figure 2:
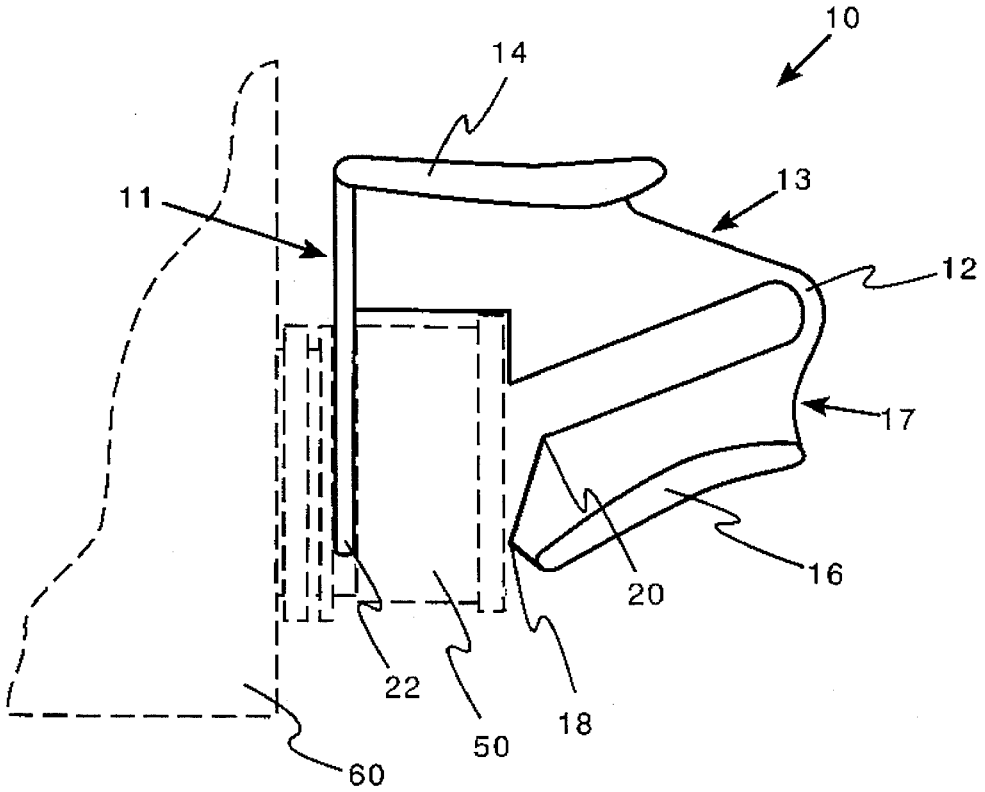
FIG. 2 shows it in elevation view installed in the operational position on a generic valve assembly.

FIG. 2 shows a side view of one embodiment 10 of the invention having a support means for mounting on a nozzle 50 of a bag-in-the-box fluid container providing increased mechanical advantage and an improved position to open and close a spigot valve located inside the nozzle. The fluid container 60 has an integral, normally closed valve spigot. A lever opens the spigot by lifting resilient liquid sealing plastic to allow fluid to fill portable containers. A support means for vertical mounting 11 on a nozzle has an arch 24 fitting into the nozzle top groove with parallel side fingers 22 that extend downward and into the nozzle side grooves at the center of the fluid container nozzle. Preferably the arch has an inside radius that is similar to the nozzle groove inside diameter but any shape connecting the fingers and fitting into the top groove with fingers positioned for fitting inside side grooves may be used. The fingers are spaced to fit snugly into the side grooves of the various size nozzles now manufactured. The vertical means for mounting may encompass most of the nozzle if desired. If grooves are not available on the nozzle, the support means for vertical mounting may be applied over the outer diameter of a nozzle and have more surface area to maintain the support means on the nozzle.

Attached to the front center of the support means for vertical mounting and extending forward at about right angles that will be above the nozzle is an upper surface means for positioning a finger or thumb position. A pad 14 may be attached on the top surface of this extending member to provide more area for placement of a finger or thumb. A front part of the upper surface means is a means for providing a pivoting motion. One pivoting means is a thin resilient extension 12 that narrows and reverses direction. This section provides flexibility to recover to original shape when this section is moved. This thin section provides a motion similar to a pivot connection between the upper surface means and lower surface means. The thin resilient extension continues to form a lower surface means for opening the spigot valve, directly positioned under the top surface means. This lower surface means extents under the spigot valve lever. The lower surface may have an optional lower surface pad 16 attached to the bottom of the surface for placing a finger or a thumb. When a compressive force is applied between a finger and thumb, the lever located on the spigot is raised and this opens the resilient plastic seal allowing fluid to flow from the container and out the bottom of the nozzle. The upper and lower surface means may have various thickness and shapes such as round, square, and rectangular or Tee I, or C shapes to provide adequate rigidity and strength, the necessity relating to the construction material. Angle supports to the support means for vertical mounting may be added. Preferably the invention is a single piece as shown and made from plastic. The materials for construction may be metal or thermoplastic or thermosetting plastics. Both rigid materials such as polypropylene, polyamide, polyvinyl chloride, polyethylene, and ABS or flexible materials such as rigid plastics with plasticers, polyurethane, Buna elastomers, silicones, and other elastomers may be used for construction. Injection molding is a preferred method of manufacture.

Figure 3:
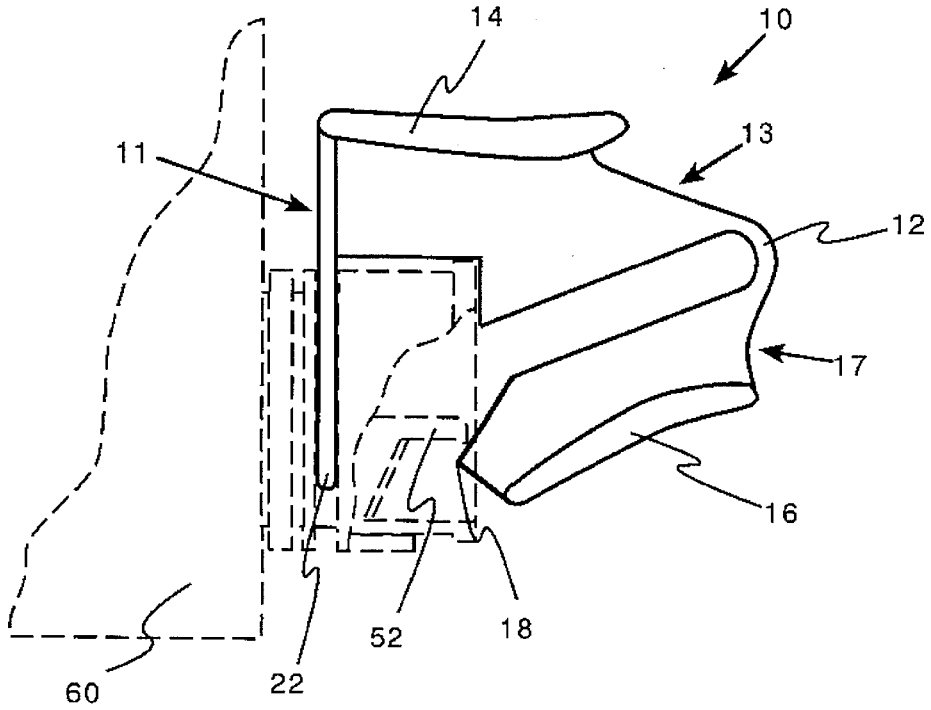
FIG. 3 shows it with the generic valve assembly cut away.

FIG. 2 shows one embodiment of the invention mounted on bag-in-the-box fluid container 60. The nozzle and spigot valve assembly 50 has one or a plurality of grooves. FIG. 3 is a front view of the operator showing the mounting and the location of the spigot valve operator relative to the nozzle. The mechanism is located in front and above the nozzle to provide easy access for filling any size portable container away from the fluid flow area.

FIG. 3 shows the relationship of the contact point 18 to the valve stem 52 on the cut away of the generic valve assembly 50. This would be in the normally closed or no flow position.

Figure 4:
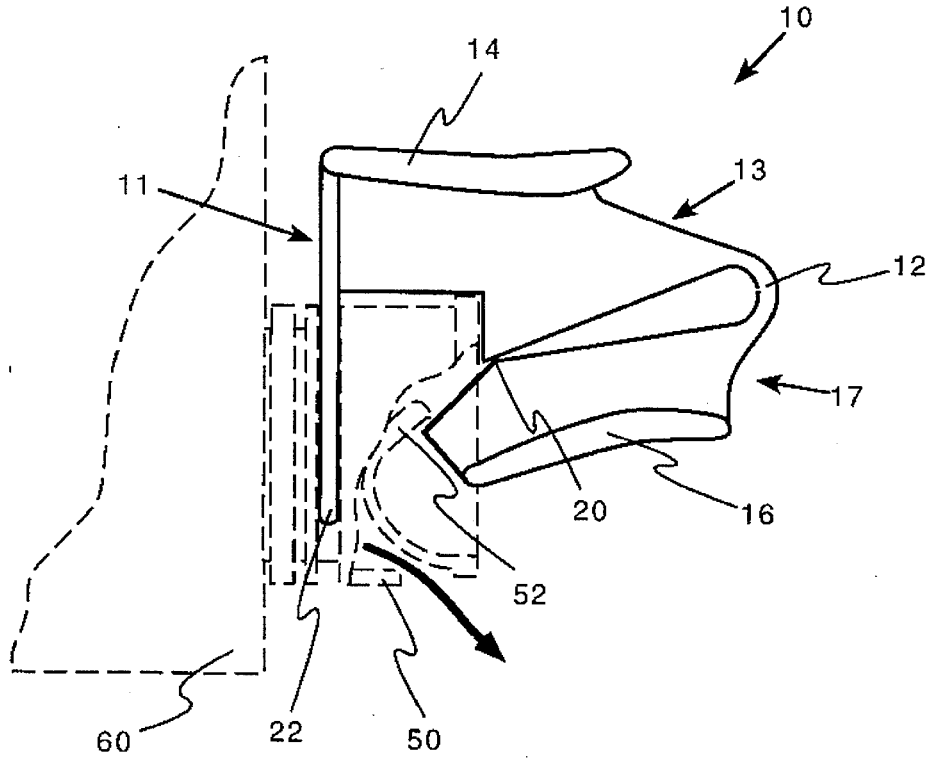
FIG. 4 shows it in the fully compressed mode as would result from squeezing action applied by a thumb and forefinger, resulting in full flow from the bag-in-the-box container.

As can best be appreciated by reference to FIG. 4, the valve stem 52 is shown in the full flow position which is accomplished by placing a thumb on the thumb perch 14 and forefinger on the finger perch and pressing the forefinger upward toward the thumb causing hinge 12 to flex until stop 20 limits the movement. This action simultaneously causes the contact point 18 to move the valve stem 52 to the open position thus allowing full fluid flow as indicated by the arrow. Upon releasing this pressure by removing the thumb and forefinger the resilience of the flexible hinge 12 returns the single piece body 10 to the as manufactured state thereby allowing the inherent recovery of the generic valve assembly 50 to the normally closed position.

Figure 5:
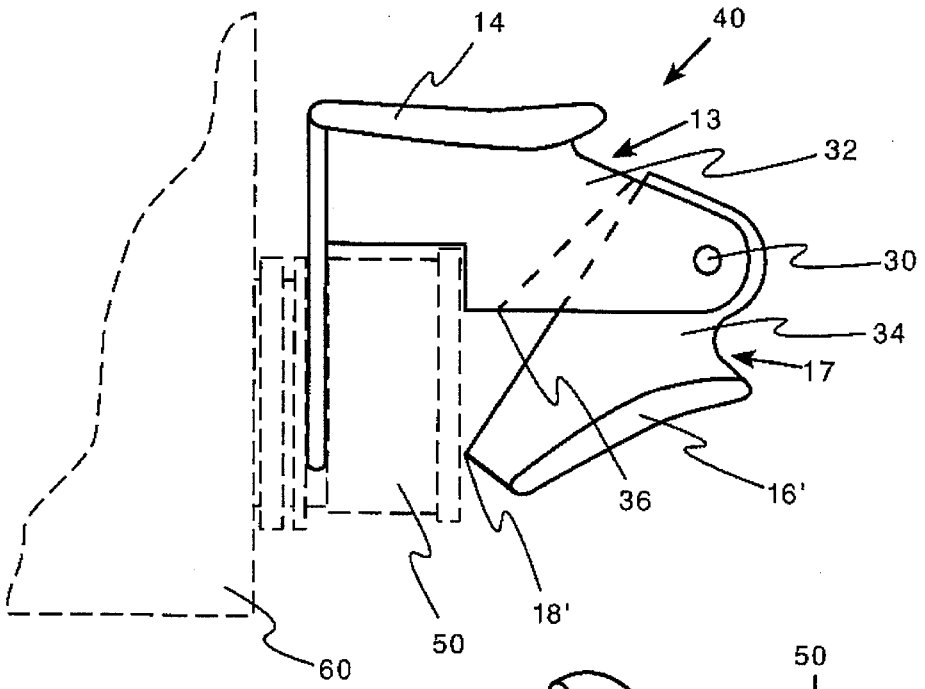
FIG. 5 shows an additional embodiment utilizing a pivot in place of the resilient plastic connection of FIGS. 1 thorough 4.
Figure 6:
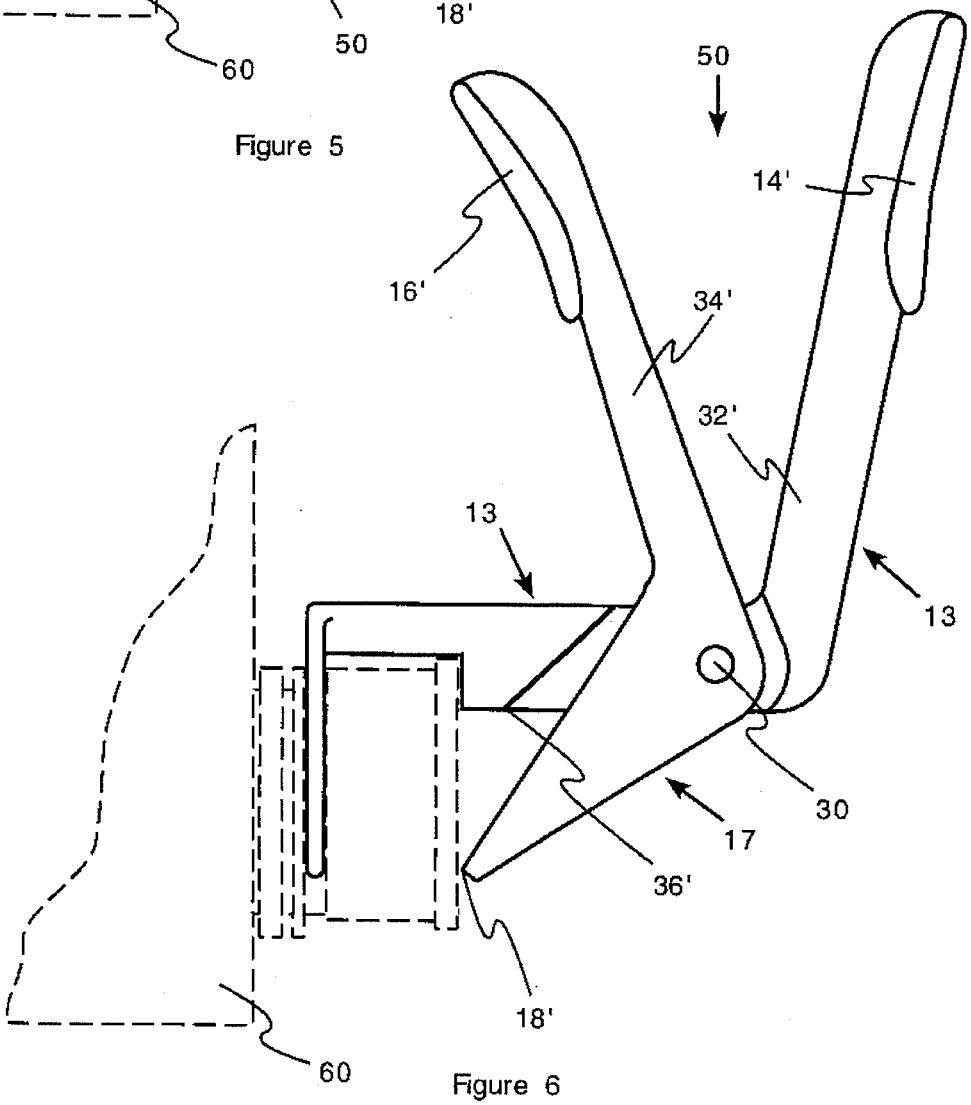
FIG. 6 shows a similar embodiment of FIG. 5 but providing greater mechanical advantage.
Figure 7:
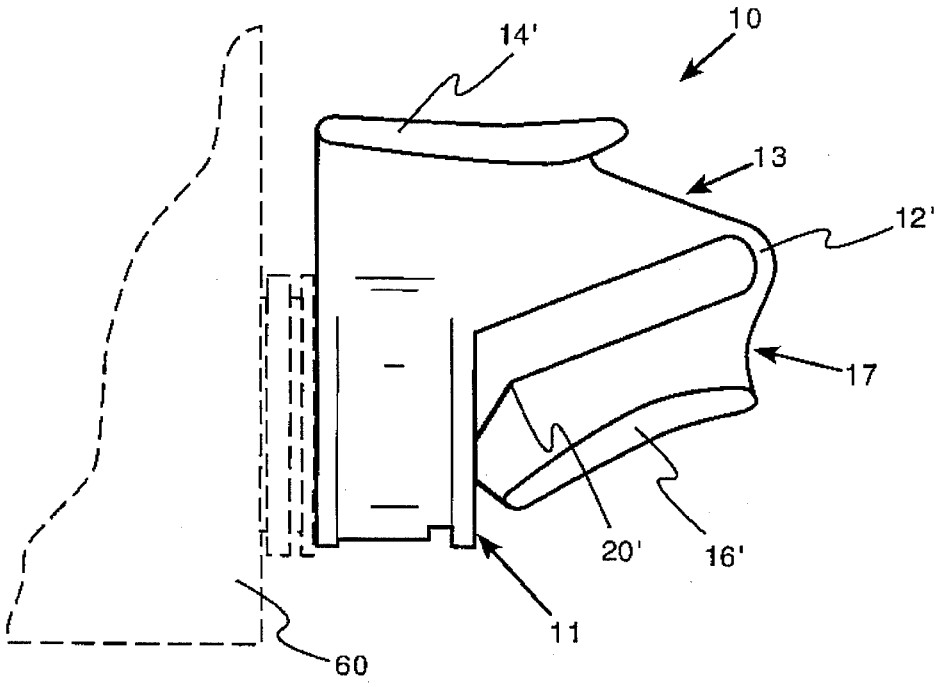
FIG. 7 shows an embodiment in which the invention is cast as an integral unit with the generic valve assembly.

In the additional embodiments shown in FIG. 5 through 7, like reference numerals differentiated by a prime (') suffix have been used to identify the same or similar elements corresponding to elements in the prior embodiment.

FIG. 5 embodiment consist of a moveable member 34 which moves in a slotted fixed member 32 on a pivot 30. When the thumb and forefinger squeeze this embodiment it allows contact point 18' to depress the valve stem, as in FIG. 4, to the open position wherein the inner slot stop 36 prevents over travel. This embodiment returns to the closed position when the fingers are removed, by a combination of gravitational force acting on the movable member 34 and the resilient recovery of the generic valve assembly 50' thus stopping flow.

The upper surface and lower surface means are separate parts. The pivot may be a protrusion located either upper surface means 13 or bottom surface means 17 extended to provide areas for mounting a pivot and thereby allowing the other surface to rotate. The pivot may also be a separate device constructed from metal or plastic and not firmly attached to either means.

FIG. 6 shows another embodiment where the upper and lower surface means for positioning a finger or a thumb are extended beyond the pivot point of FIG. 5 for additional mechanical advantage and easier access. The upper surface means 40' extends beyond a pivot 30' having an extended length 32' to provide additional mechanical advantage. The lower surface means 34' begins under the valve lever, passes through the pivot, and extends a similar length and direction on top or behind the upper surface. The extensions beyond the pivot may be at an angle extending above from the pivot point or extend directly forward. An upper angle position of about 90 degrees allows better access to fill portable containers. Opposing finger and thumb pads 14 and 16 may be added on the surface means extensions. The surface means are positioned so a compressive force by a finger and thumb between the extended ends of these surface means opens the container valve. A stop position at meet point 36' prevents over stressing the operator or the spigot valve.

Figure 8:
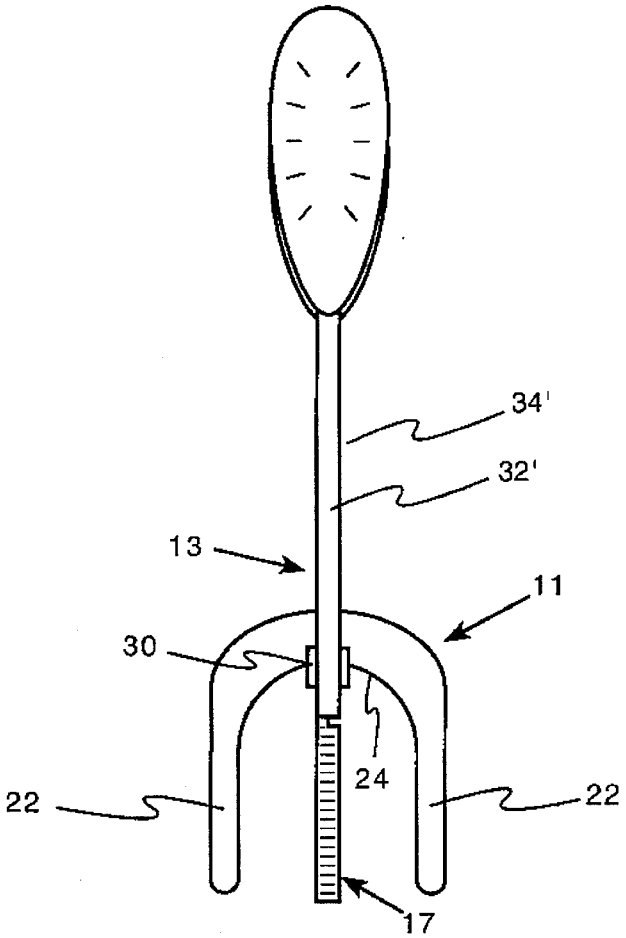
FIG. 8 is a front view of FIG. 6 embodiment having greater mechanical advantage.

FIG. 7 shows a means for vertical mounting on, a nozzle having more surface area. This means could mount on a nozzle having no grooves. FIG. 8 is a front view of FIG. 6 indicating the relative positions of the extended surfaces.

The additional embodiment shown in FIG. 6 effectively moves the thumb perch 14' and finger perch 16' further from the pivot 30' affording greater leverage therefore requiring less force to effect operation of the multiple piece valve operator 40'. Functionally the operation is the same as FIG. 5.

FIG. 7 is functionally the same as FIG. 1, however the method of construction is a homogenous molded device including a generic valve assembly and a single piece valve operator thus comprising the unitary valve operator 70.

It will be appreciated from the description of the invention that all of these embodiments will be a simple molded product which will ease the operational difficulty of generic bag-in-the-box valves experienced by many individuals.

Although the present invention has been described with a certain degree of particularity, it is understood that the present disclosure has been made by way of example, and changes in detail or structure may be made without departing from the spirit of the invention, as defined in the appended claims.

I claim:

1. A valve operator to aid in dispensing fluids from bag-in-the-box containers having a nozzle and spigot valve comprising:

(a) a support means for mounting on said valve operator over said container nozzle, (b) a upper surface member means for positioning a finger or thumb attached to said support means for mounting, and extending outwardly over top of said nozzle, (c) said upper surface means outward portion located frontly of said nozzle connects to a surface means for providing pivoting motion and, (d) a lower surface means for positioning a finger or thumb position attached to said surface means for providing a pivoting motion, extending inwardly inside said nozzle to under said spigot valve whereby a compressive force between said finger or thumb located over said upper surface member and said finger or thumb located under said lower surface opens said spigot valve.

2. A valve operator to aid in dispensing fluids from bag-in-the-box containers having a nozzle and spigot valve as described in claim 1 wherein said surface means for providing pivoting motion is a thin, narrow, resilient extension.

3. A valve operator to aid in dispensing fluids from bag-in-the-box containers having a nozzle and spigot valve as described in claim 1 wherein said support means for mounting over said container nozzle is an arch with parallel side fingers.

4. A valve operator to aid in dispensing fluids from bag-in-the-box containers having a nozzle and spigot valve comprising:

(a) a support means for mounting said valve operator over said container nozzle, (b) a upper surface member means for positioning a finger or thumb, attached to said support means for mounting, and extending outwardly over top of said nozzle, to a pivot and beyond, (c) a lower surface means for positioning a finger or thumb position extending outwardly inside said nozzle from under said spigot valve to said pivot and beyond in a position relative to said upper surface means whereby a compressive force beyond the pivot between said finger or thumb located over said upper surface member and said finger or thumb located under said lower surface opens said spigot valve.

5. A valve operator to aid in dispensing fluids from bag-in-the-box containers having a nozzle and spigot valve as described in claim 4 wherein said support means for mounting over said container nozzle is an arch with parallel side fingers.

6. A valve operator to aid in dispensing fluids from bag-in-the-box containers having a nozzle and spigot valve comprising:

(a) a support means for mounting said valve operator over said container nozzle, (b) a upper surface member means for positioning a finger or thumb attached to said support means for mounting and extending outwardly over top of said nozzle to a pivot, (c) a lower surface means for positioning a finger or thumb position attached to said upper surface means by said pivot and extending inwardly inside said nozzle to under said spigot valve whereby a compressive force between said finger or thumb located over said upper surface member and said finger or thumb located under said lower surface opens said spigot valve.

7. A valve operator to aid in dispensing fluids from bag-in-the-box containers having a nozzle and spigot valve as described in claim 6 wherein said support means for mounting said valve operator over said container nozzle is an arch with parallel side fingers.

* * * * *